US006182772B1

(12) United States Patent
Lagasse et al.

(10) Patent No.: US 6,182,772 B1
(45) Date of Patent: Feb. 6, 2001

(54) APPARATUS AND METHOD FOR DRIVING POSTS INTO THE GROUND

(76) Inventors: Charles A. Lagasse, 87 Wallace Rd.; James R. Sheldon, 196 Nashua Rd., both of Bedford, NH (US) 03110

( * ) Notice: Under 35 U.S.C. 154(b), the term of this patent shall be extended for 0 days.

(21) Appl. No.: 09/271,555

(22) Filed: Mar. 18, 1999

(51) Int. Cl.[7] ..... B25D 11/00

(52) U.S. Cl. ..... 173/1; 173/32; 173/122; 173/124; 173/117; 173/203

(58) Field of Search ..... 173/202, 203, 173/205, 124, 117, 32, 122, 49, 90, 1

(56) References Cited

U.S. PATENT DOCUMENTS

| | | | | |
|---|---|---|---|---|
| 2,927,773 | * | 3/1960 | Wilke | 173/203 |
| 3,139,944 | * | 7/1964 | Smith | 173/122 |
| 3,543,868 | * | 12/1970 | Drake | 173/202 |
| 3,612,188 | * | 10/1971 | Ono | 173/122 |
| 3,937,286 | | 2/1976 | Wagner | 173/119 |
| 3,961,672 | | 6/1976 | Welsch et al. | 173/43 |
| 4,135,585 | * | 1/1979 | Wagner | 173/124 |
| 4,665,994 | | 5/1987 | Snider | 173/90 |
| 4,732,220 | * | 3/1988 | Johnsson | 173/202 |
| 4,984,640 | * | 1/1991 | Gillan et al. | 173/205 |
| 5,088,567 | | 2/1992 | Schnell et al. | 173/122 |
| 5,819,857 | | 10/1998 | Rohrer | 173/90 |

* cited by examiner

*Primary Examiner*—Scott A. Smith

(57) ABSTRACT

A portable apparatus for driving a post into the ground is provided in an embodiment. The apparatus has a base removably attachable to the post as well as a hammer module tethered to the base to permit vertically reciprocating motion of the module relative to the base and post. The apparatus may be motor driven with rotating, eccentrically mounted cams providing the mechanism for creating a hammering force through reciprocating motion. The hammer module has a face which imparts the hammering force to the top of the post. A method for using such an apparatus is provided in a further embodiment.

16 Claims, 9 Drawing Sheets

APPARATUS AND METHOD FOR DRIVING POSTS INTO THE GROUND

TECHNICAL FIELD

The present invention relates to post driving methods and portable apparatus to perform such functions.

BACKGROUND ART

For centuries, posts have been driven into the ground by applying an essentially downward force at or near the top of a post. Humans may apply intermittent, brute force with sledgehammers or similar instruments. Machines may apply such force continuously or intermittently so long as the total energy imparted is sufficient to embed the post to a desired depth while not damaging the post. Pistons, actuated mechanically or hydraulically, may lack portability, be unwieldy, or cause post damage.

SUMMARY OF THE INVENTION

Various embodiments of the present invention solve problems associated with the prior art. Embodiments afford, for example, easy handling by an operator and a hammering force intended to decrease the chance of post damage.

Accordingly, a portable apparatus for driving a post into the ground is provided in an embodiment of the present invention. The apparatus has a base which is removably attachable to the post and a hammer module which is tethered to the base. The hammer module is so tethered to permit vertically reciprocating motion relative to the base and has a face for transmitting force to the top of the post. The base and the hammer module constitute an assembly which includes a drive arrangement to cause vertical reciprocation of the hammer module. In an embodiment, the assembly includes a frame, a motor mounted to the frame, an axle coupled to the motor, and a cam mounted on the first axle. In another embodiment of the invention, the assembly also includes a second axle having a second cam mounted on it. The axles and the motor have axes of rotation which are parallel to a reference axis. The second axle is coupled to the motor to rotate in a direction opposite to the direction of the first axle. Centroids of the cams are, alternately, simultaneously above and simultaneously below the axes of rotation of the first and second axle, so as to cause the hammer module to reciprocate vertically.

In accordance with a preferred embodiment, the hammer module has two ends and is elongate essentially along a long axis that is generally horizontal and transverse to the axes of rotation with the face proximate a working end of the hammer module. The base has a body and an arm that is pivotally attachable to a pivoting end of the hammer module, so that it is the working end which reciprocates vertically. The apparatus may also include a damping mechanism coupled between the base and the working end. A constraint upon vertical reciprocation may, in this way, be provided.

A further embodiment of the present invention is a method for driving a post into the ground including providing an apparatus in accord with a previously described embodiment, positioning it so that its face engages the top of the post, and powering the drive arrangement of the apparatus.

DETAILED DESCRIPTION OF THE INVENTION

Figure 10:
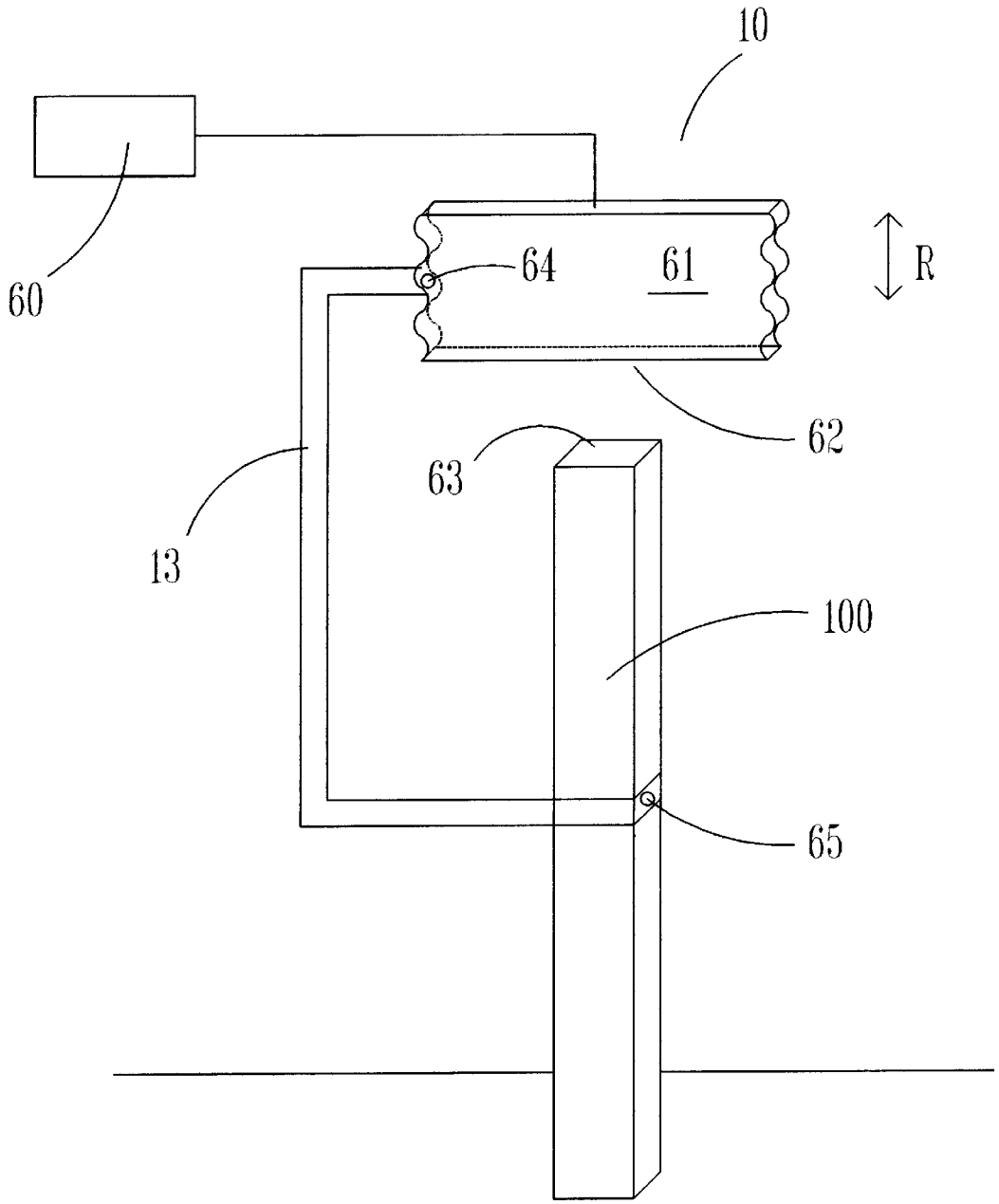
FIG. 10 is a longitudinal view, schematically representing the elements of a portable post driver according to an embodiment of the invention.

FIG. 10 is a longitudinal view, schematically representing the elements of a portable post driver 10 according to an embodiment of the invention. This embodiment includes an assembly having a base 13, shown attached to post 100 at attachment point 65. Further, the base 13 is shown tethered to a hammer module 61 at tethering point 64. The assembly also includes an associated drive arrangement 60 which may or may not be disposed within hammer module 61. Drive arrangement 60, in operation, causes hammer module 61 to reciprocate vertically, as shown by arrow R. The reciprocating motion of the module 61 causes an essentially downward hammering force to be transmitted via module face 62 to a top 63 of post 100. The portable post driver 10 is intended to efficiently drive post 100 into the ground while a user experiences minimal vibration or other discomfort while holding on to the base 13 during operation. The amount of hammering force imparted by the reciprocating action is intended to be sufficient to move the post 100 into the ground without damaging it. The base 13 may include a latch or other fastener for attachment to post 100 as well as a handle for convenience of the user. The user may, during operation, apply some downward force upon the handle to provide any required guidance or alignment of the driver 10 to insure that the downward portion of arrow R essentially coincides with a desired post-driving direction. The module 61 is tethered to the base 13 so that, in an embodiment, a module face 62 may engage the top 63 of the post 100 and impart the hammering force. The associated drive arrangement 60 may, for example, have a motor which spins a cam upon an axle to provide power to initiate and maintain reciprocating motion of the face 62. The arrangement 60, alternatively, may be based upon electrical, electromechanical, magnetic, or other mechanisms known in the art which will provide this type of reciprocating motion.

Figure 1:
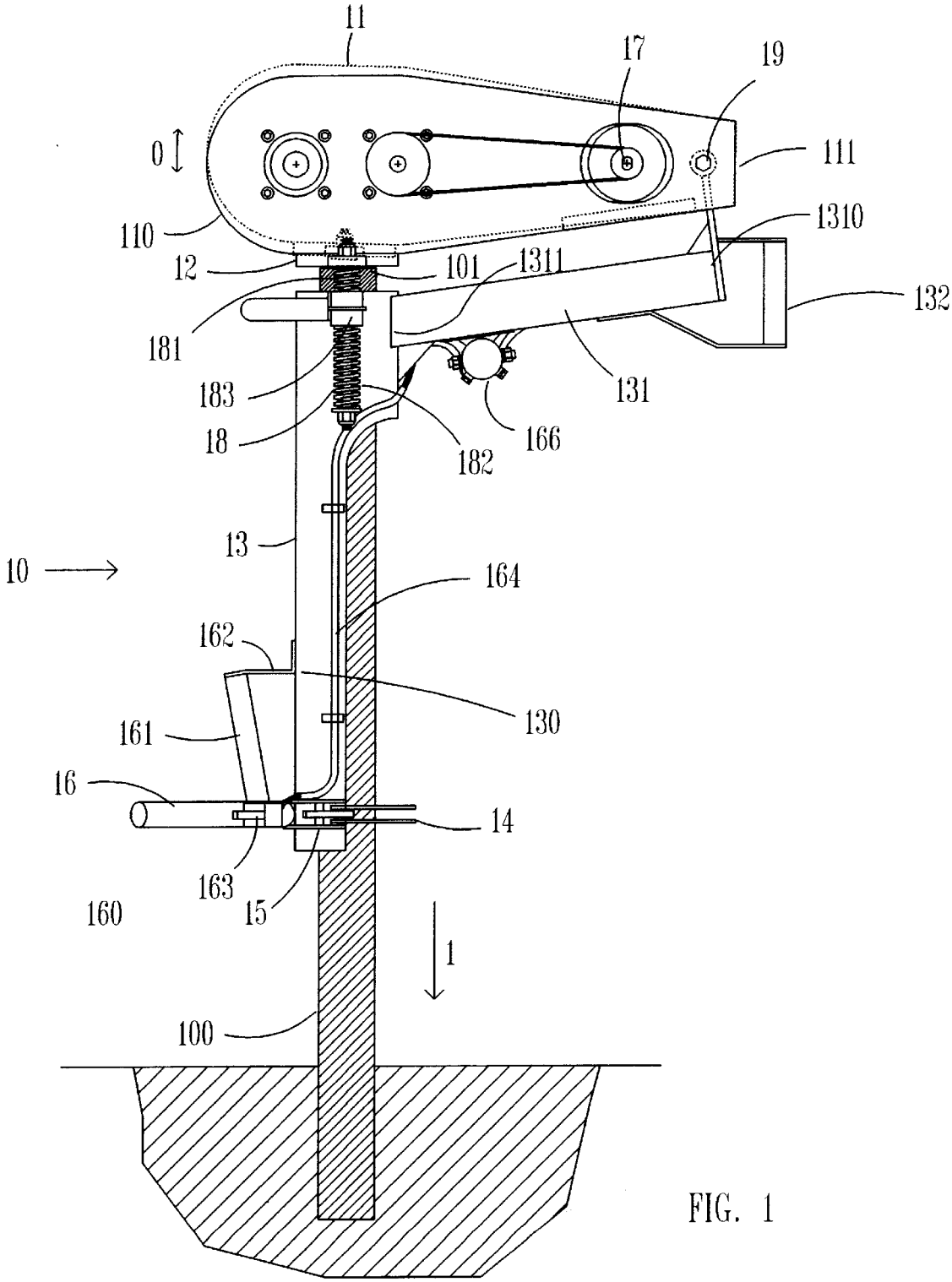
FIG. 1 is a longitudinal view of a post driver according to an embodiment of the invention.

FIG. 1 shows a preferred embodiment of a portable post driver 10 in accordance with the present invention. An elongate frame 11 having a working end 110 and a pivoting end 111 defines a structural portion of a hammer module. Working end 110 is caused to vertically reciprocate (shown as arrow O) in, essentially, the post driving direction (shown by arrow 1). A face, which in this embodiment is a striker plate 12, is coupled to the frame 11 at or near the working end 110 and is oriented so that reciprocation of working end 110 causes it to strike the top 101 of a post 100, thereby imparting an essentially downward hammering force upon post 100. Striker plate 12 is, preferably, made from hardened metal capable of withstanding repeated impacts with tops of metal posts.

Figure 7:
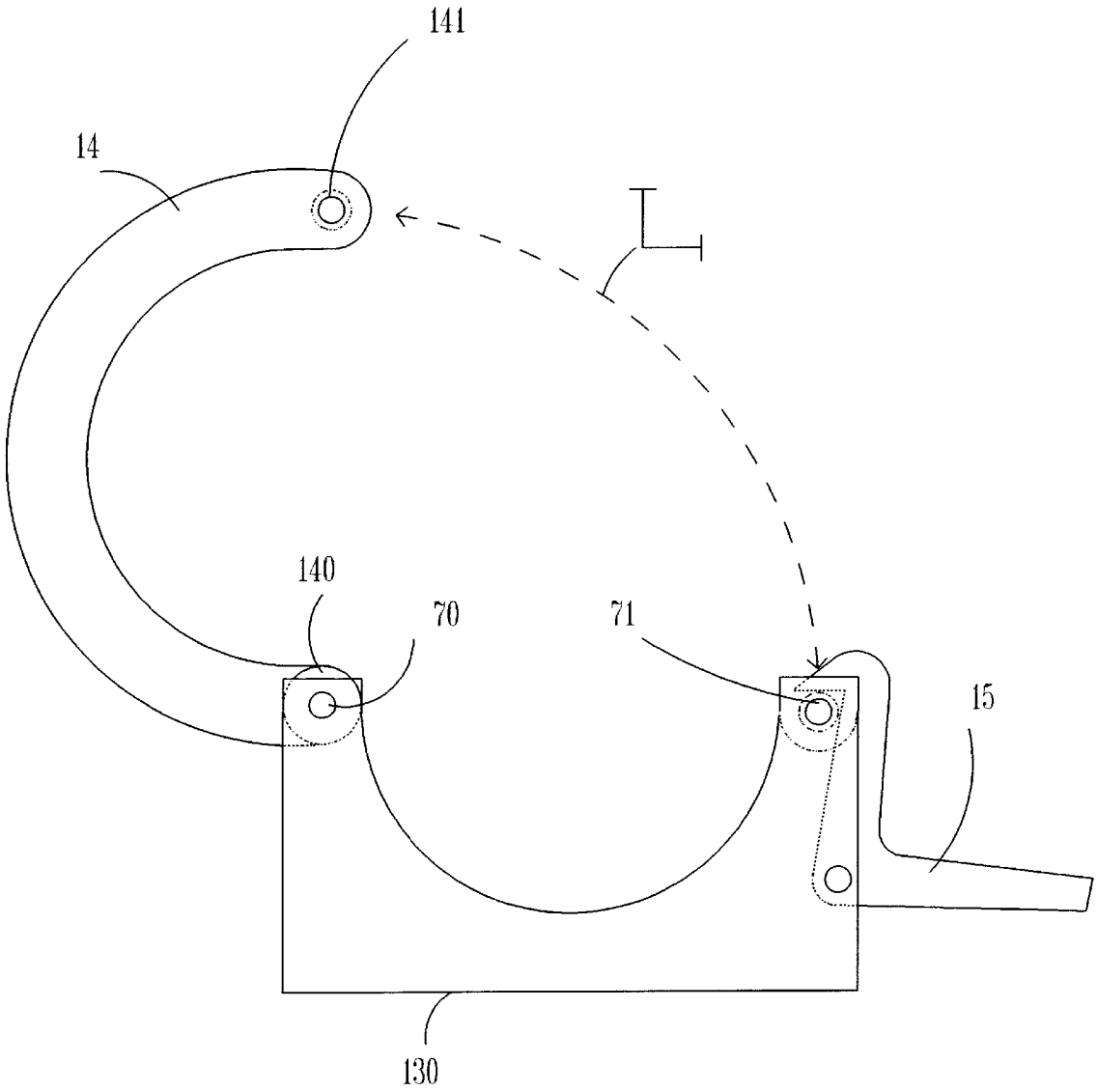
FIG. 7 is a top view of a latching mechanism, in accordance with an embodiment of the invention.

Base 13, in this embodiment, includes a body 130 and an arm 131. Body 130 is oriented essentially parallel with the length of post 100 and is removably attached to post 100. Latch 14, when engaged with clasp 15, adjustably secures post 100 to body 130. A top view of a latching mechanism, in accordance with an embodiment of the invention, is shown in FIG. 7. Here, end 140 of latch 14 is pivotally attached to body 130 at pivot point 70. End 141 of latch 14 is rotated in the general direction of arrow L to fit around the periphery of a post 100 so that end 141 is adjacent to body 130 at attachment point 71. Clasp 15 may then be used to secure end 141 to body 130. Embodiments of a latching mechanism include, within the scope of the invention, components sized and shaped to accommodate a variety of styles and cross-sections of post which are known in the art. Mechanical clasps as shown may be substituted with other fasteners known in the art within the spirit of the present invention.

Figure 8:
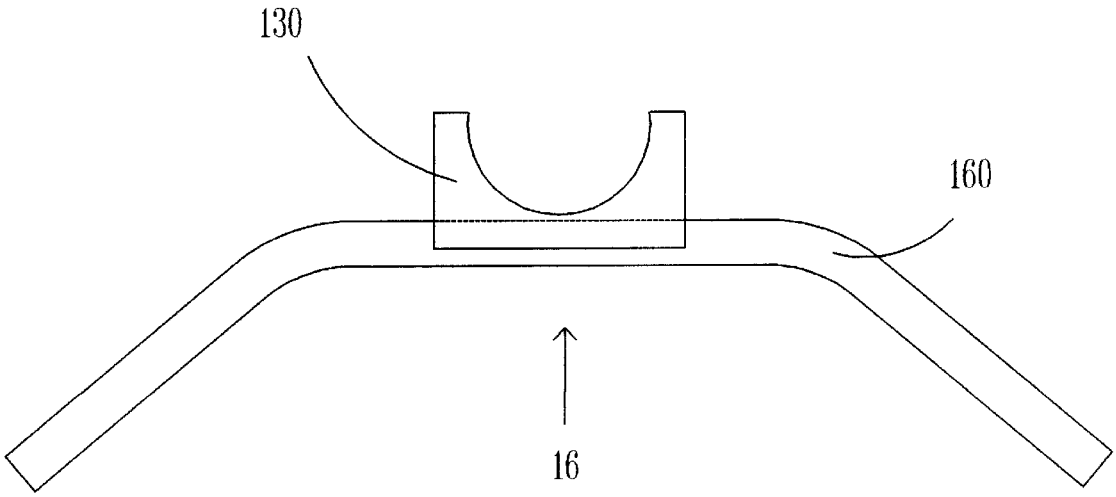
FIG. 8 is a top view of an operator handle, in accordance with an embodiment of the invention.

An operator handle 16 having a grip 160 is secured to a side of body 130 adjacent clasp 15 and circumferentially opposite to latch 14. Operator handle 16 is further supported upon body 130 with handle member 161 attached to operator handle 16 on one member end. Handle member 161 is, itself, secured to body 130 by bracket 162. A top view of an operator handle 16, in accordance with an embodiment of the invention, is shown in FIG. 8. The handle 16 shown is designed for two-handed use; however, other configurations may be used within the spirit of the present invention. In addition, a weight (not shown) may be coupled with handle 16 to further reduce undesirable vibration during operation of post driver 10.

Arm 131 is pivotally coupled, near arm end 1310, to the pivoting end 111 of frame 11 at joint 19. Carrier handle 132 is attached to arm 131 near arm end 1310 to afford a convenient way for a user to carry portable post driver 10 when it is detached from a post 100. Opposite arm end 1311 is attached to body 130. Vertical reciprocation of working end 110 is generated when motor 17 is activated. An operator accomplishes motor activation and deactivation by turning switch 163 on or off. Switch 163 is shown positioned adjacent to operator handle 16 for convenient operation. Power cable 164, mounted on body 13, provides power communication between switch 163 and motor 17. Motor 17 may, for example, be a 12 volt DC motor powerable by a suitable battery or other 12 volt DC source. Solenoid 166 is shown electrically coupled between switch 163 and motor 17, in line with power cable 164.

Springs 18 are attached between body 130 and working end 110 proximate to striker plate 12. Springs 18 provide another base-hammer module connection in addition to the pivoting connection at joint 19. Springs 18, in the embodiment shown, serve to dampen and constrain the amount of reciprocation of working end 110. The springs 18 may also assist, when tuned with the reciprocating forces and accounting for the rigidity of the pivoting connection at joint 19, to more efficiently return the striker plate 12 to top 101. The effectiveness of the resultant hammering force and the speed of post driving may be enhanced by efficient use of springs 18 having appropriately advantageous spring constants and damping characteristics. In the specific embodiment of FIG. 1, springs 18 are an assemblage including upper springs 181 and lower springs 182 which are separated by dividing plate 183. The inventors have preferredly used upper springs 181 of about 1 inch diameter and about 1.5 inch length and lower springs 182 of about 1 inch diameter and about 4 inch length. Upper springs 181 are preferredly rated at about three times the force constant as lower springs 182 (for example, upper springs 181 may be rated at about 600 lb/in and lower springs 182 rated at about 200 lb/in).

Figure 2:
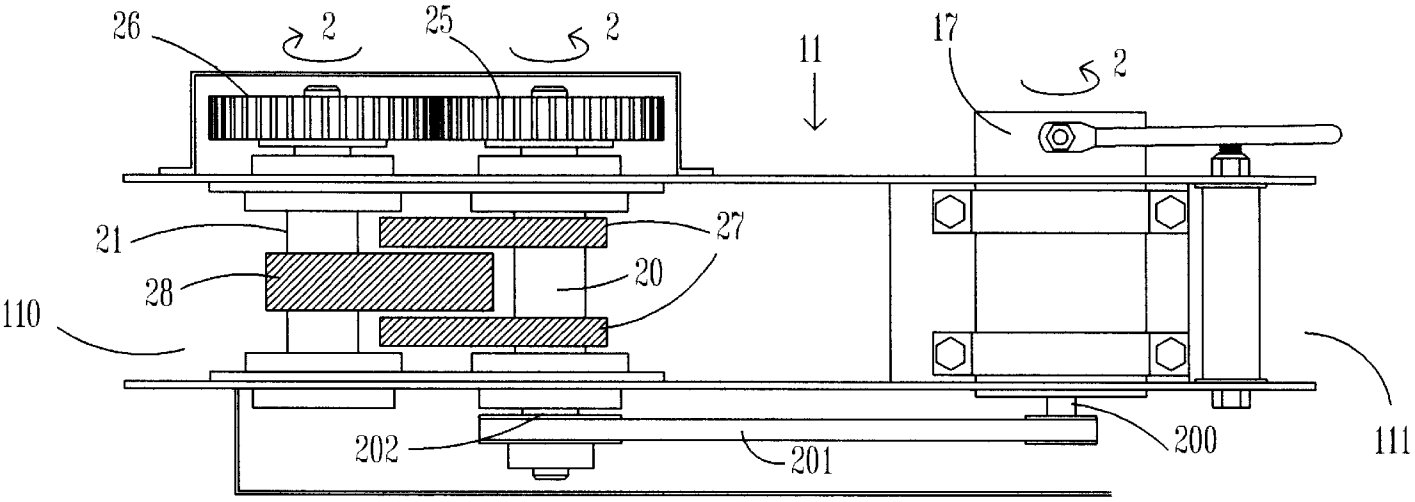
FIG. 2 is a top cross-sectional view of a hammer module and associated drive arrangement according to an embodiment of the invention. In this view, cam centroids are positioned between the axles.
Figure 3:
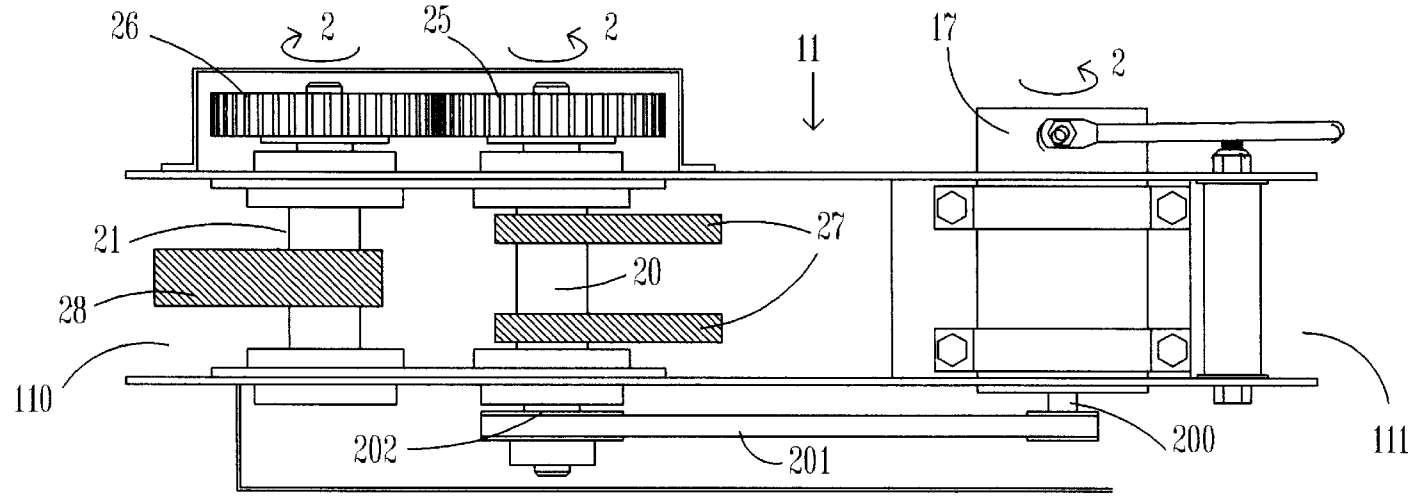
FIG. 3 is a top cross-sectional view of a hammer module and associated drive arrangement according to the embodiment of FIG. 2. In this view, the axles have been rotated 180° from the position shown in FIG. 2.

FIGS. 2 and 3 are top cross-sectional views of an embodiment of a hammer module and an associated drive arrangement. A cut-away of frame 11 illustrates the mechanically coupled components which provide, when operational, reciprocating motion of working end 110. Other mechanical, electromechanical, or magnetic drive arrangements which will produce reciprocating motion of working end 110 are within the spirit of the present invention.

Figure 4:
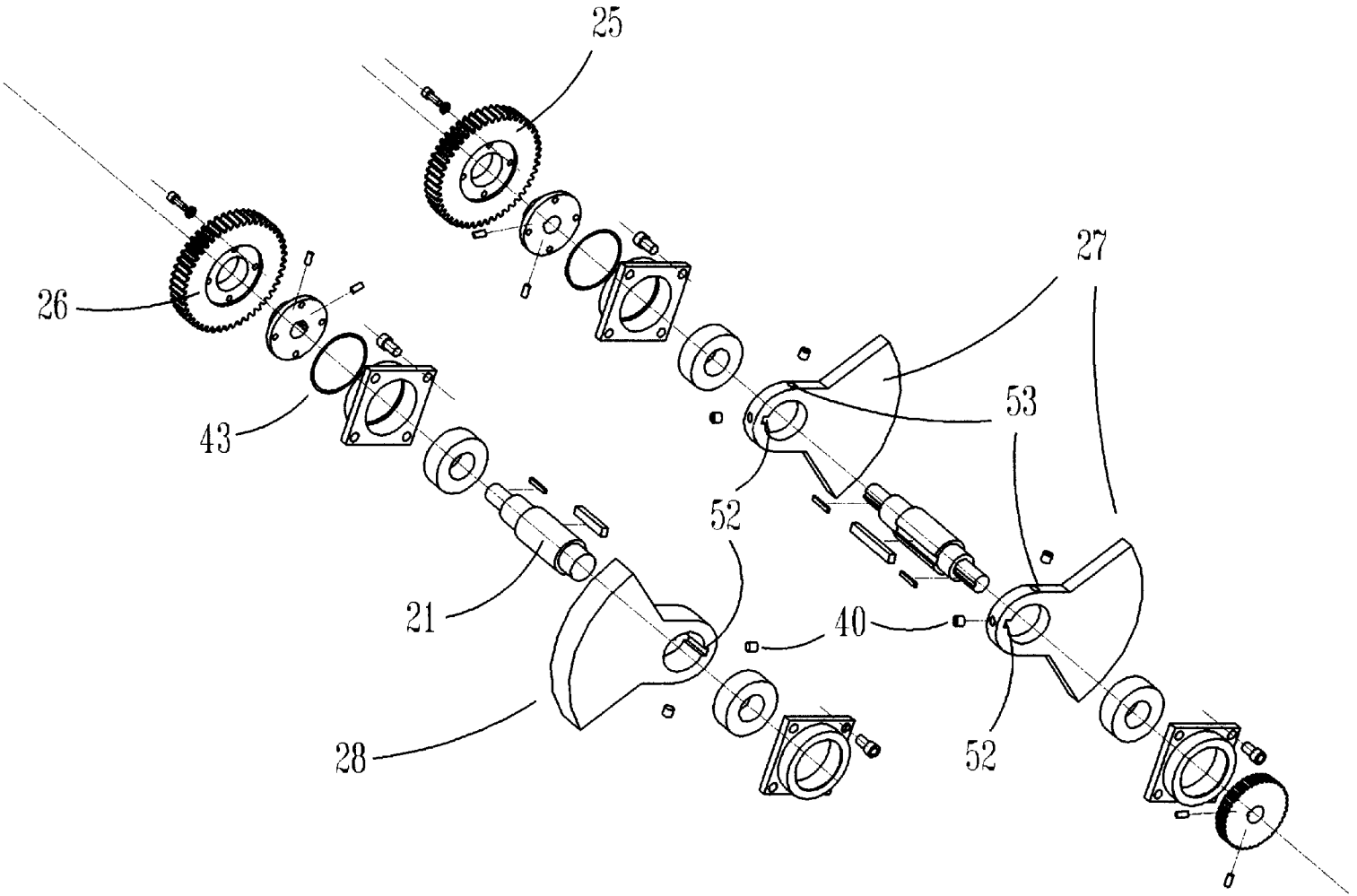
FIG. 4 is an exploded view of components of the drive arrangement for a hammer module according to an embodiment of the invention. Three cams are included in this embodiment as are in FIGS. 2 and 3.
Figure 5:
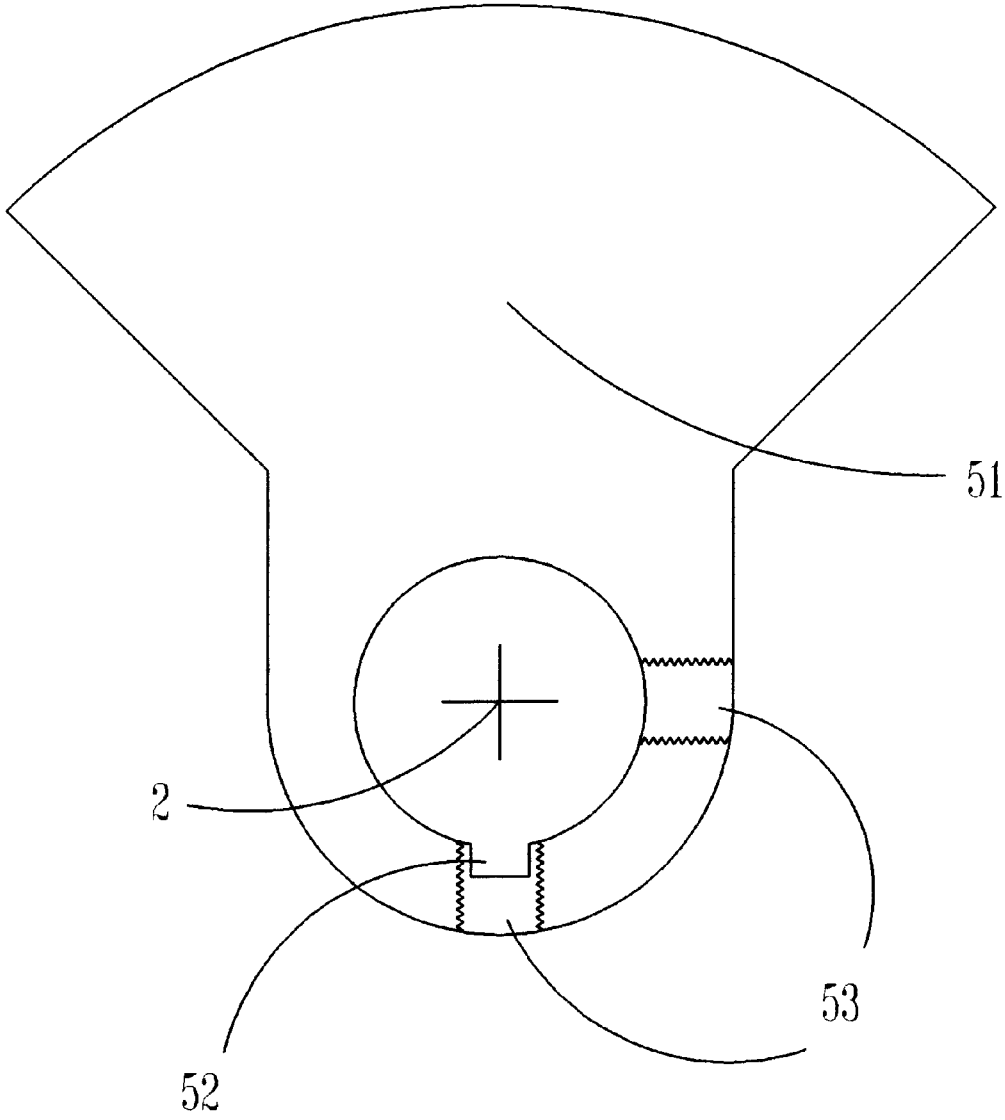
FIG. 5 is a plan view of a cam according to an embodiment of the invention.

Motor 17 is mounted to frame 11 proximate pivoting end 111. When motor 17 is activated, motor shaft 200 rotates. Belt 201 mechanically couples rotary motion of motor shaft 200 with that of a first axle shaft 202 of a first axle 20. First gear 25, mounted inapposite to belt 201 on first axle shaft 202, is coupled with a second gear 26, mounted on second axle 21 so that second axle 21 rotates in an opposite direction from first axle 20. Reference axis 2 is, herein, defined such that the axes of rotation of first axle 20, second axle 21, and motor 17 are parallel to axis 2. Two first axle cams 27 are eccentrically mounted upon first axle 20; one second axle cam 28 is eccentrically mounted upon second axle 21. Cams 27 and 28 are particularly mounted at positions along their respective axle lengths so that the cams 27 and 28 are perfectly free to rotate. Two first cams 27 may each have a different thickness than second cam 28. Cams 27 and 28 may, as shown in FIGS. 4 and 5, be indexed about their respective axles 20 and 21 by a key way 52. Tapped holes 53 are provided for mounting first cams 27 and second cam 28 to axles 20 and 21 with set screws (item 40 in FIG. 4). Cams 27 and 28 are, in this embodiment, bell-shaped. FIG. 5 shows the position of cam centroid 51.

Figure 6:
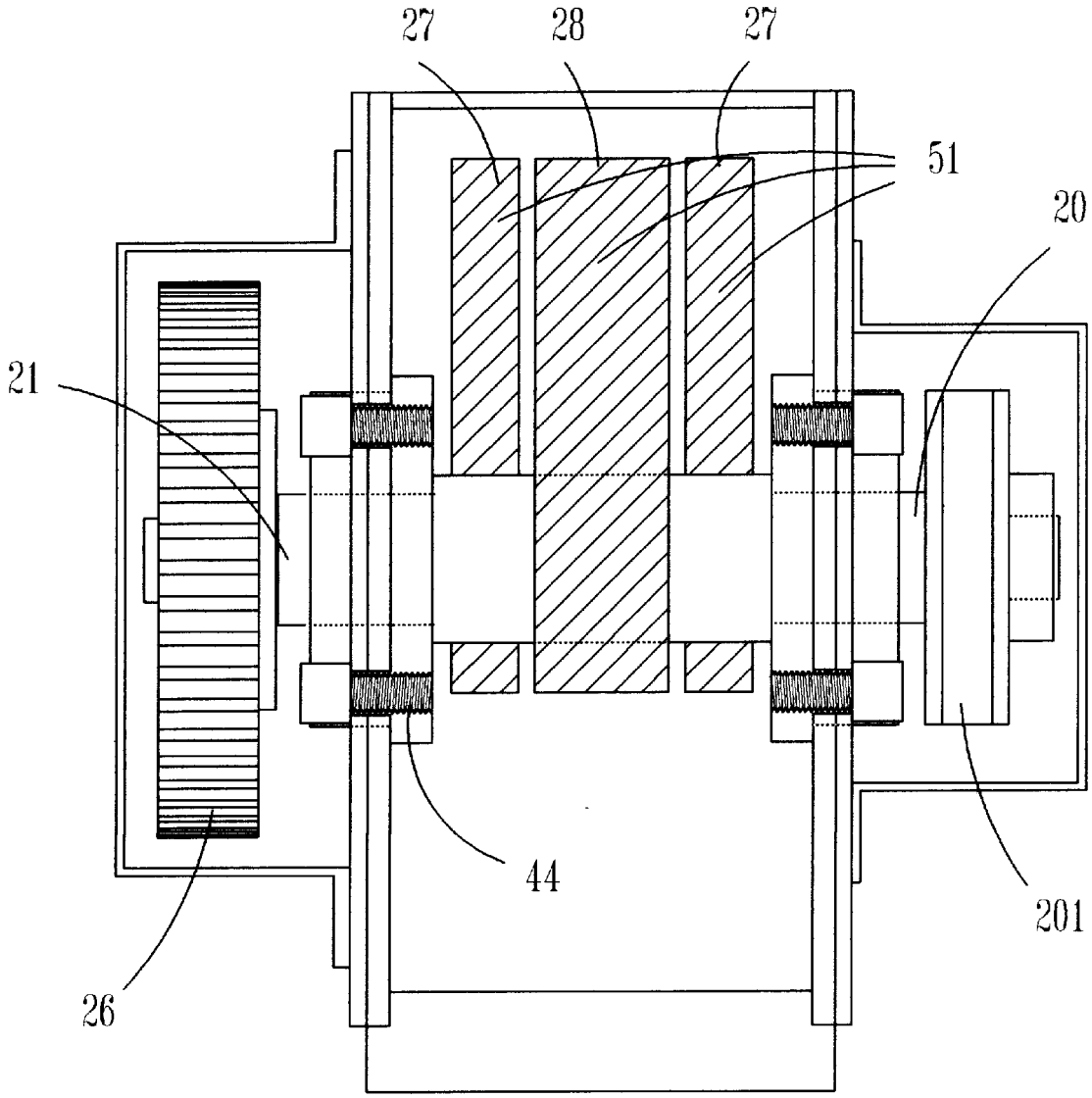
FIG. 6 is a side cross-sectional view of a drive arrangement with the cams in a position in which each of the cam centroids is simultaneously above the axes of rotation of the axles upon which the cams are mounted.

Cam centroids 51 are, when cams 27 and 28 are mounted on their respective axles, not collinear with the axes of rotation 2 of first axle 20 and second axle 21. FIG. 2 shows a relative axle position in which the centroids 51 of cams 27 and 28 are laterally positioned between first axle 20 and second axle 21. FIG. 3 shows a relative axle position following a 180° rotation from the position of FIG. 2. Movement of centroids 51 is such that they alternate between being in a first position where the centroids 51 are simultaneously above and a second position in which the centroids are simultaneously below their respective axles' axes of rotation causes the hammer module to reciprocate vertically. FIG. 6 illustrates cams 27 and 28 in the first position. Note, that the first and second positions occur at relative axle positions 90° out of phase from the positions shown in FIGS. 2 and 3. Note, also, that when the centroids 51 are in the first position and are simultaneously above the axles, force balance calculations made upon the hammering module would predict that a peak in the downward hammering force occurs in the first position. Thus, when the cam centroids 51 are at their highest position relative to the essentially vertical post driving direction, O, the force to move the working end 110 downward is at a maximum and the module will impact post 100. Movement of centroids 51 to their lowest relative position will force the working end 110 upward. Upward motion of working end 110 will be constrained by springs 18 which will further, as the springs 18 are stretched, provide some additional downward force during the following rotational cycle of axles 20 and 21. Spring compression on the next half cycle may provide additional upward force to that provided by centroid movement.

FIG. 4 is an exploded view of first axle 20, second axle 21, cams 27 and 28, and associated mounting hardware known in the art. Flanges 41, grommets 42, sealers 43, are assembled using bolts 44. The relative positions of cams 27 and 28 are indexed as previously described.

Figure 9:
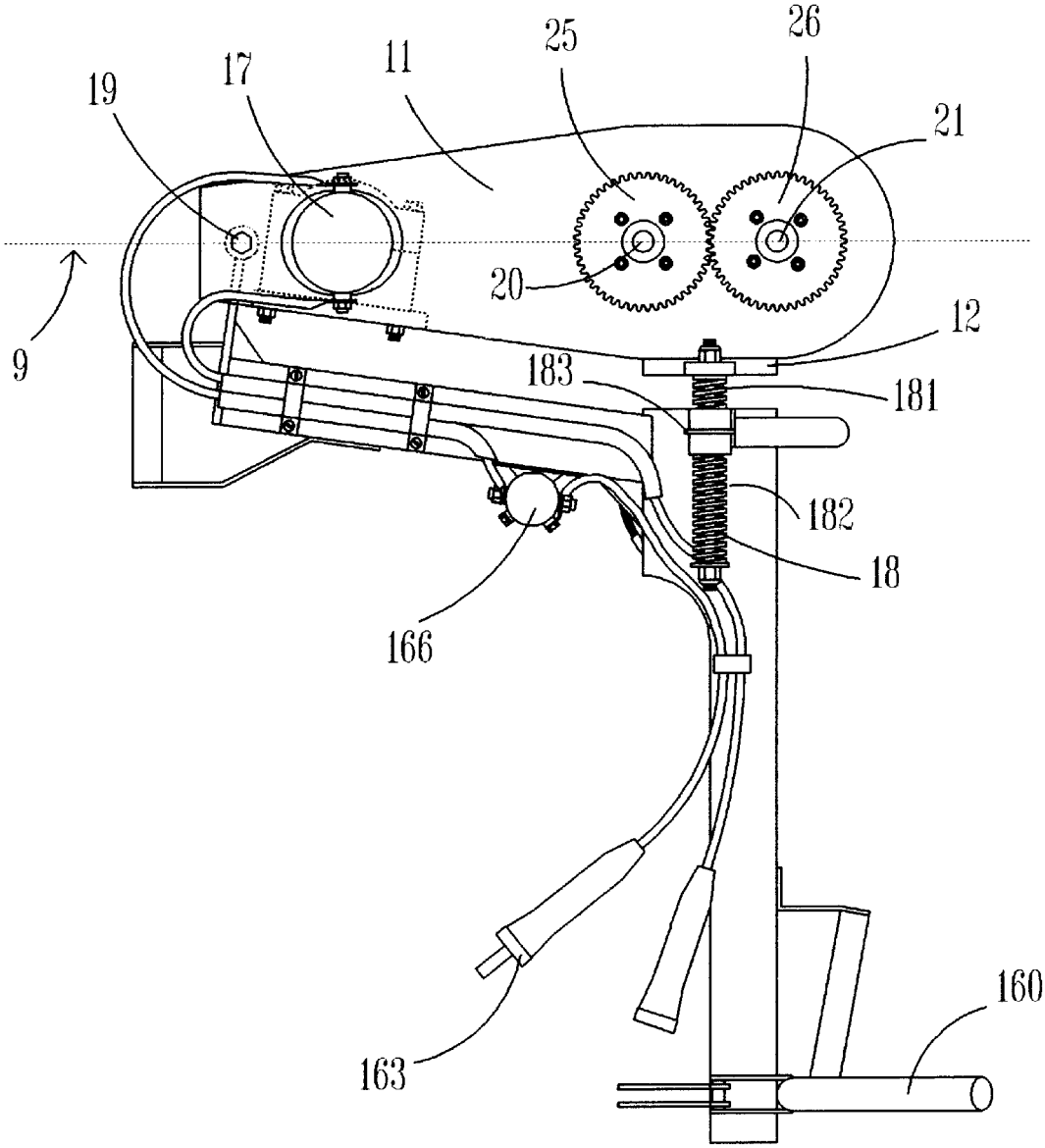
FIG. 9 is a longitudinal view of the opposite side of the post driver of FIG. 1.

FIG. 9 illustrates the side of the post driver opposite the side shown in FIG. 1. Gear 25, driven by motor 17, causes gear 26, and axle 21 to rotate in the opposite direction to motor 17 and axle 20. Frame 11 is elongated along axis 9. In this embodiment, striker plate 12 is located between first axle 20 and second axle 21 measured along axis 9.

An optimum running speed for motor 17 is, approximately, 2600 rpm. The inventors have used, in an embodiment, a gear ratio of about 2:1 resulting in a speed of axles 20 and 21 of about 1300 rpm. First cams 27 used weighed about 1.4 lb each; while second cam 28 was about twice the weight of each first cam 27. As in FIGS. 2 and 3, the second cam 28 used had about twice the overall thickness of each first cam 27.

Although the invention has been described with reference to several preferred embodiments, it will be understood by one of ordinary skill in the art that various modifications can be made without departing from the spirit and the scope of the invention, as set forth in the claims hereinbelow.

What is claimed is:

1. A portable apparatus for driving a post into the ground, the post having a top, the apparatus comprising:

a base, removably attachable to the post, wherein the base has a body and an arm;

a hammer module, coupled to the base, so as to permit vertically reciprocating motion of the hammer module relative to the base, and having a face for transmitting force to the top of the post and wherein the hammer module, in operation, is elongate along a generally horizontal long axis so that the hammer module has two opposed ends, a working end and a pivoting end, through which the long axis passes, the face proximate the working end and the arm pivotally attachable to the pivoting end, so that the working end reciprocates vertically;

the base and the hammer module constituting an assembly, the assembly including:

a drive arrangement, so as to cause the hammer module to reciprocate vertically and to impart a hammering force from the face to the top of the post.

2. An apparatus according to claim 1, further comprising:

a damping mechanism coupled between the base and the working end so as to provide constraint on reciprocation of the working end.

3. An apparatus according to claim 2 wherein the damping mechanism includes a spring.

4. An apparatus according to claim 1, further comprising:

a latch for removably attaching the post to the base.

5. A portable apparatus for driving a post into the ground, the post having a top, the apparatus comprising:

a base, removably attachable to the post; and a hammer module, coupled to the base, so as to permit vertically reciprocating motion of the hammer module relative to the base, and having a face for transmitting force to the top of the post;

the base and the hammer module constituting an assembly, the assembly including:

a frame;

a motor mounted to the frame;

a first axle, coupled to the motor; and a first cam mounted on the first axle, wherein the frame, motor, first axle, and first cam are disposed in the hammer module so as to cause the hammer module to reciprocate vertically and to impart a hammering force from the face to the top of the post.

6. An apparatus according to claim 5, further comprising:

a second axle; and a second cam, mounted on the second axle, wherein the first axle and the second axle have axes of rotation that are parallel to a reference axis, the second axle coupled to the motor to rotate in a direction opposite to the direction of the first axle and, wherein centroids of the cams alternate between a first position in which the centroids are simultaneously above and a second position in which the centroids are simultaneously below their respective axles' axes of rotation, so as to cause the hammer module to reciprocate vertically.

7. An apparatus according to claim 6, wherein the base has a body and an arm and wherein the hammer module, in operation, is elongate along a long axis that is generally horizontal and transverse to the reference axis, so that the hammer module has two opposed ends, a working end and a pivoting end, through which the long axis passes, the face proximate the working end and the arm pivotally attachable to the pivoting end, so that the working end reciprocates vertically.

8. An apparatus according to claim 7, wherein the face is located at a position along the long axis between the first axle and the second axle.

9. An apparatus according to claim 7, further comprising:

a damping mechanism coupled between the base and the working end so as to provide constraint on reciprocation of the working end.

10. An apparatus according to claim 9 wherein the damping mechanism includes a spring.

11. An apparatus according to claim 5, further comprising:

a latch for removably attaching the post to the base.

12. A method for driving a post into the ground, the post having a top, the method comprising:

(A) providing a portable apparatus having:

a base, removably attachable to the post; and a hammer module, coupled to the base, so as to permit vertically reciprocating motion of the hammer module relative to the base, and having a face for transmitting force to the top of the post;

the base and the hammer module constituting an assembly, the assembly including:

a frame;

a motor mounted to the frame;

a first axle, coupled to the motor;

a first cam mounted on the first axle, a second axle; and a second cam, mounted on the second axle, wherein the assembly's frame, motor, first axle, and first cam, and are disposed in the hammer module, the first axle and the second axle having axes of rotation that are parallel to a reference axis, the second axle being coupled to the motor to rotate in a direction opposite to the direction of the first axle and, wherein centroids of the cams alternate between a first position in which the centroids are simultaneously above and a second position in which the centroids are simultaneously below their respective axles' axes of rotation, so as to cause the hammer module to reciprocate vertically;

(B) positioning the apparatus so that the face engages the top of the post, and (C) powering the motor.

13. A method according to claim 12, wherein the base of the apparatus has a body and an arm and wherein the hammer module of the apparatus, in operation, is elongate along a long axis that is generally horizontal and transverse to the reference axis, so that the hammer module has two opposed ends, a working end and a pivoting end, through which the long axis passes, the face proximate the working end and the arm pivotally attachable to the pivoting end, so that the working end reciprocates vertically.

14. A method according to claim 13, wherein the face of the apparatus is located at a position along the long axis between the first axle and the second axle.

15. A method according to claim 13, wherein the apparatus further includes:

a damping mechanism coupled between the base and the working end so as to provide constraint on reciprocation of the working end.

16. A method according to claim 12, wherein the assembly's second axle and second cam are disposed in the hammer module.

* * * * *